United States Patent [19]

Moser

[11] 4,433,936

[45] Feb. 28, 1984

[54] DEVICE FOR DRIVING AND POSITIONING TOWELS INTO CONCRETE SLABS

[76] Inventor: Andreas Moser, 21, Vrijheidstraat, 2000 Antwerp, Belgium

[21] Appl. No.: 313,402

[22] Filed: Oct. 21, 1981

[30] Foreign Application Priority Data

Nov. 7, 1980 [BE] Belgium ..... 202732

[51] Int. Cl.[3] ..... E01C 23/04

[52] U.S. Cl. ..... 404/88; 404/100; 404/118

[58] Field of Search ..... 404/88, 100, 83, 72, 404/87, 118, 120, 114

[56] References Cited

U.S. PATENT DOCUMENTS

| | | | |
|---|---|---|---|
| 1,780,427 | 11/1930 | Kirkham | 404/120 X |
| 2,224,194 | 12/1940 | Mitchell | 404/88 |
| 2,295,947 | 9/1942 | Heltzel | 404/88 |
| 2,389,773 | 11/1945 | Golden | 404/88 |
| 2,596,206 | 5/1952 | Carnes | 404/100 |
| 2,641,168 | 6/1953 | Heltzel | 404/87 |
| 3,045,566 | 7/1962 | Houck | 404/87 |
| 3,098,413 | 7/1963 | Guntert et al. | 404/87 |
| 3,403,609 | 10/1968 | Bradshaw et al. | 404/118 X |
| 3,657,977 | 4/1972 | Hudis | 404/100 |
| 3,816,014 | 6/1974 | Klopf | 404/114 |
| 3,817,644 | 6/1974 | Matson | 404/114 |
| 3,891,338 | 6/1975 | Smith et al. | 404/118 X |

FOREIGN PATENT DOCUMENTS 800703 6/1973 Belgium .

2406925 1/1978 Fed. Rep. of Germany .

*Primary Examiner*—Ernest R. Purser
*Assistant Examiner*—Beverly E. Hjorth
*Attorney, Agent, or Firm*—Sughrue, Mion, Zinn, Macpeak and Seas

[57] ABSTRACT

This invention relates to a device for driving and positioning, by vibration, dowels into concrete slabs during the construction of roads, on both sides of points between said slabs and perpendicularly to said joints, comprising a horizontal beam which is provided with vibrators and with maintaining elements suitable for gripping the dowels and which is carried by an independent frame, so as to be vertically movable by displacement means above a joint, in order to drive said dowels into a lower position in the still unhardened concrete of the slabs.

The device also comprises a lower smoothing plate intended to bear and slide onto the surface of the already compacted concrete slab, said lower plate having openings for the passage of the dowels and pressing guides fixed to the horizontal beam during the lowering of said horizontal beam, said elements for maintaining the dowels being connected to the horizontal beam and to the pressing guides so as to allow the horizontal beam and the pressing guides to move downwardly with respect to the maintaining elements bearing on the lower plates, so as to cause the dowels to be driven into the still unhardened concrete of the slabs.

10 Claims, 4 Drawing Figures

DEVICE FOR DRIVING AND POSITIONING TOWELS INTO CONCRETE SLABS

PRIOR ART

The German Pat. No. 2,406,925 discloses a device carried by a compacting-finishing machine, said device being used for driving and positioning steel dowels into the freshly poured concrete of a slab of a concrete road. The device comprises a horizontal beam comprising a plurality of dowel magazines and pressing guides forming pairs of elements located in front of each other and directed downwardly, the purpose of said guides being to push the dowels out of supporting grips maintaining said dowels in a waiting position and to drive said dowels into a lower position in the still not hardened concrete of the slabs, said grips being able to slide vertically and transversally with respect to the horizontal beam. In order to avoid an interruption of the advancement of the compacting-finishing machine during the positioning of the dowels, the device is carried by a carriage suspended to rails and adapted so as to move along said machine.

This known device has however several disadvantages.

When the dowels are driven into the concrete, the supporting grips bear in the lower position against the still plastic surface of the slabs, so that said surface is damaged.

Moreover, since the still plastic slab or plate is not maintained in place when the dowels are driven into the concrete by vibration, the concrete mass may be disturbed in such a way that it is necessary to add concrete. A further smoothing step is therefore generally necessary after the dowels have been driven into the concrete by means of the known device.

During each positioning step of the dowels, the displacements of the known device with respect to the compacting-finishing machine may cause a pitching of the latter, so that unacceptable level variations are created in the finished slabs.

This invention relates to a device for positioning dowels into the joints of road concrete slabs or plates, said device having not the disadvantages of the known techniques. The dowels are placed parallel to each other on both sides of the joints between the slabs, perpendicularly to the latter.

In the present specification, the term "dowel" relates to a pin or similar bar allowing the shrinkage or contraction of the concrete of the slabs to which it is connected and constituting an element transmitting the loads on both sides of the joint between said slabs.

BRIEF DESCRIPTION OF THE INVENTION

The device according to the invention for driving and positioning by vibration dowels into concrete slabs during the construction of concrete roads, on both sides of the joints between said slabs and perpendicularly to said joints, comprises a horizontal beam provided with vibrators and with maintaining means intended to grip the dowels and which is mounted on an independent frame so as to be vertically movable by displacing means above a joint, in order to drive said dowels in a lower position into the still unhardened concrete of the slabs, said device being essentially characterized by the fact that it comprises a lower smoothing plate intended to bear against and to slide onto the surface of the already compressed concrete slab, said lower plate having openings for the passage of the dowels and of passing guides fixed to said horizontal beam during the downward movement of this horizontal beam and by the fact that said maintaining elements of the dowels are connected to the horizontal beam and to the pressing guides so as to enable the horizontal beam and the pressing guides to move downwardly with respect to the maintaining elements bearing against said lower plate, in order to cause the dowels to be driven into the still not hardened concrete of the slabs.

The lower plate or smoothing plate of the device according to the invention inhibits damages of the surface of the slabs due to vibrations, when the dowels are driven into the concrete.

The device according to this invention may be realized as a smoothing and dowelling device which is independent of the compacting-finishing machine. It is then attached to a compacting-finishing machine provided with a sliding shuttering which distributes, compresses and finishes a concrete slab and advances continuously, by means of driving means allowing a discontinuous movement of said device with respect to said machine, so as to avoid the stop of this machine during the positioning step of the dowels.

The device according to the invention may also be directly attached to the frame of a compacting-finishing machine. This involves the interruption of the continuous advancement of this machine during the positioning of the dowels but, contrarily to the known device, this stop is not a disadvantage, since the efforts exerted for the driving of the dowels into the concrete are not transferred to the frame of the compacting-finishing machine, but to the lower plate or smoothing plate of the device.

In a preferred embodiment of the invention, the device may be suspended from to a horizontal beam connected to the frame of the compacting-finishing machine, by means of sliding or linking means, which are capable of causing a part of the weight of said device to be supported by said frame of the machine.

Said means may, for example, comprise a compensation mechanism which allows a constant but adjustable weight of the device to be supported by the frame of the machine.

In a particular embodiment of the device according to the invention, said linking means consist of rod pairs each forming a linked parallelogram with the horizontal beam of the frame of the machine and with the lower smoothing plate of the device.

The compensation mechanism advantageously consists of arms linked to the rods and suspended to springs. These springs may bear against a guide carried by the horizontal beam of the frame of the compacting-finishing machine. Each spring carries a rod through a nut screwed on the threaded end of each rod.

According to a further general feature of the invention, the means for displacing vertically the horizontal beam are preferably hydraulic jacks suspended to supports fixed on said lower plate of the device.

In the device according to the invention, the means for maintaining the dowels preferably consist of dowel maintaining grips and are mounted slidingly with respect to the horizontal beam, on both sides of the pressing guides, in the same manner as in the above described known device.

It is however possible to conceive other arrangements of the dowel maintaining means in the device according to the invention. Said dowel maintaining means may, for example, be mounted on the lower plate of the device, so that said means are totally independent of the horizontal beam.

DETAILED DESCRIPTION OF THE INVENTION

Other details and features of the invention will appear from the following description and from the attached drawings which show schematically and only by way of example an embodiment of the invention. In said drawings.

In said drawings, the same references designate identical elements.

The shown device is used for driving and positioning dowels 1 into concrete slabs 2 of a road. The dowels 1 extend on both sides of the contraction and dilatation joints between the slabs 2.

In the selected example, the shown device is attached to the back part of a compacting-finishing machine for continuously moulding concrete slabs 2.

Figure 1:
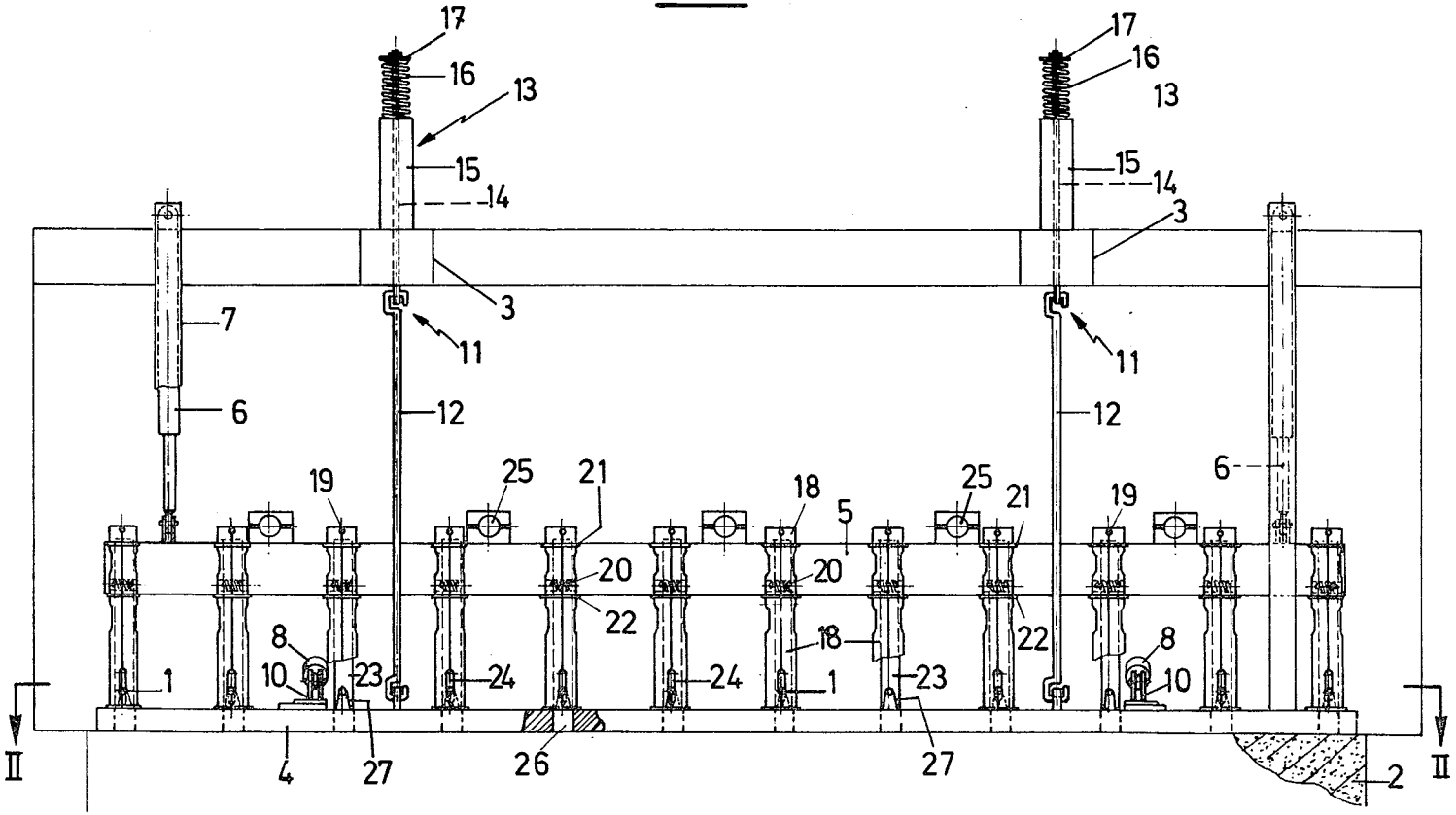
FIG. 1 is a longitudinal front view of an embodiment of the device according to the invention.
Figure 2:
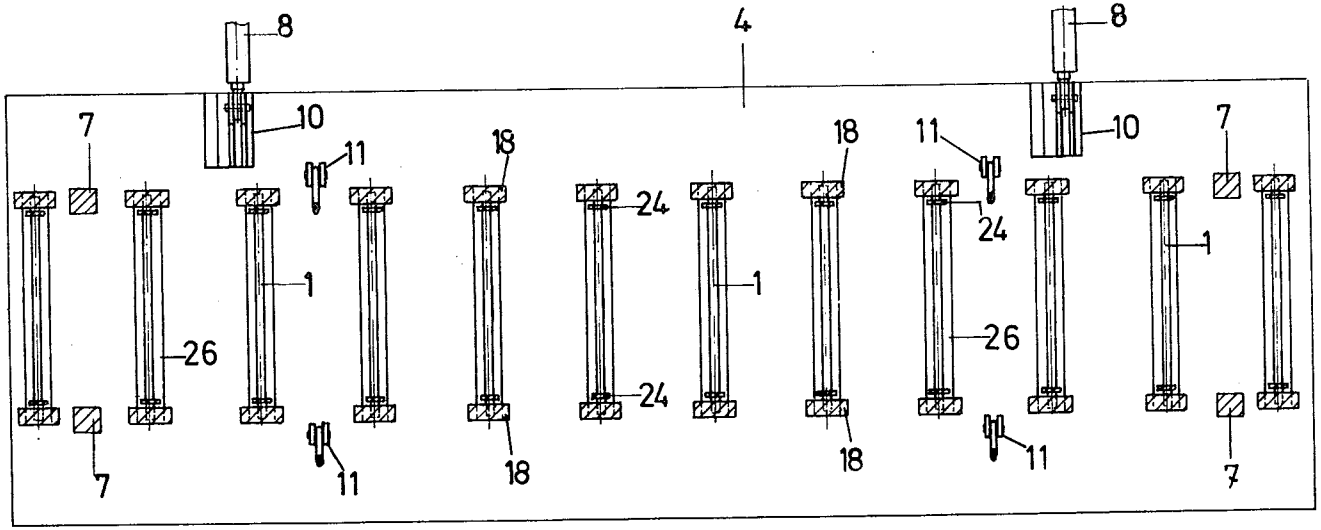
FIG. 2 is a section along the line II—II of FIG. 1.

In FIG. 1, only two back beams 3 of the compacting-finishing machine are shown for illustrative purposes.

The device for driving and positioning the dowels 1 into the concrete of the slabs 2 mainly comprises a smoothing plate 4 suspended on the back beams or extended members 3 of the frame 9 of the compacting-finishing machine and bearing on the surface of the concrete slab 2 formed by said machine, as well as a horizontal beam 5 suspended by vertically movable jacks 6 on guides or supports 7 fixed on the smoothing plate 4.

The smoothing plate 4 is connected to the frame 9 of the compacting-finishing machine by means of jacks 8.

The device for driving and positioning the dowels 1 into the concrete slabs 2 and placed on the back of the compacting-finishing machine is driven by the latter in a direction which is perpendicular to the joints between the slabs 2, and may be submitted to a translation movement with respect to the machine by actuating the jacks 8 connected to the frame 9 of the compacting-finishing machine and to the lower plate 4 of the device by a link 10.

As shown, the device is suspended, as a whole, on the beam 3 of the frame 9 of the compacting-finishing machine, preferably through link means 11 capable of causing the device to be supported with a substantially constant and adjustable force by the back beams 3 of the frame 9 of the compacting-finishing machine.

The link means 11 consist of rod pairs 12 forming each with the horizontal beam 3 of the frame 9 of the machine and with the smoothing plate 4 a linked parallelogram intended to take up a part of the efforts of driving the dowels 1 into the concrete slab 2, so as to avoid an undesirable tilting of the smoothing plate 4. Such a tilting would cause unacceptable level variations of the surface of the concrete slabs. The linked parallelograms are linked to compensation mechanisms 13 consisting of rods 14 which may be suspended from springs 16 bearing on a guide 15 carried by the horizontal beam 3 of the frame 9 of the compacting-finishing machine. The compression of the springs 16 is adjustable by changing the position of a nut 17 screwed on the threaded end of each rod 14. Thus, it is possible to adjust the load of the device on each beam 3 of the compacting-finishing machine.

The above described arrangement allows driving and positioning the dowels into the concrete without interrupting the continuous movement of the compacting-finishing machine. For each operation, it is sufficient to release the horizontally movable jacks 8 so as to stop the smoothing plate 4 on the concrete slab 2, during the positioning of the dowels 1.

When the dowels 1 have been driven and positioned into the concrete slabs 2, the device is retracted toward the compacting-finishing machine by operation of the jacks 8.

Due to the sliding movement of the smoothing plate 4 on the concrete surface, the small damages caused to the slabs by the positioning of the dowels are removed.

The dowels 1 are driven and positioned into the concrete slabs 2 by moving the horizontal beam 5 of the device. Said horizontal beam 5 is parallel to the joints beween the slabs 2 and can be moved vertically above said joints.

The raising and lowering operations of the horizontal beam 5 are controlled by the vertically moving jacks 6.

The horizontal beam 5 carries side grips 18, pairs of which are located along the longitudinal edges thereof, said grips being placed in front of each other. Each grip 18 comprises, in fact, two arms linked about an upper pivot 19 and biased toward each other by a return spring 20. The lower part of the arms of each grip 18 have recesses 24 having a width which corresponds to the diameter of the dowels 1.

Figure 3:
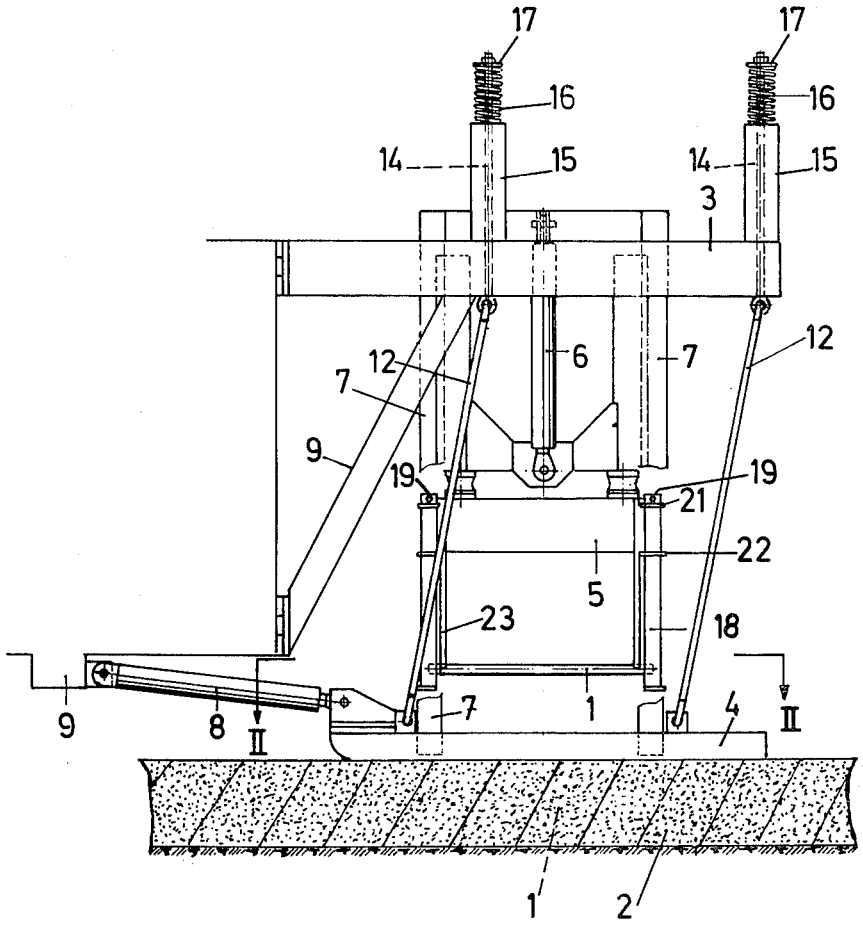
FIG. 3 is a side view of the device according to the invention.

Each grip 18 is guided by an upper side collar 21 and by a lower side collar 22 fixed to the horizontal beam 5. The upper pivot 19 of each grip 18 projects on both sides of the arms of said grip and acts as a stop for the upper side collar 21. Thus, each grip 18 allows a vertical movement of the horizontal beam 5, when the dowels 1 are driven into the concrete (FIG. 3).

Figure 4:
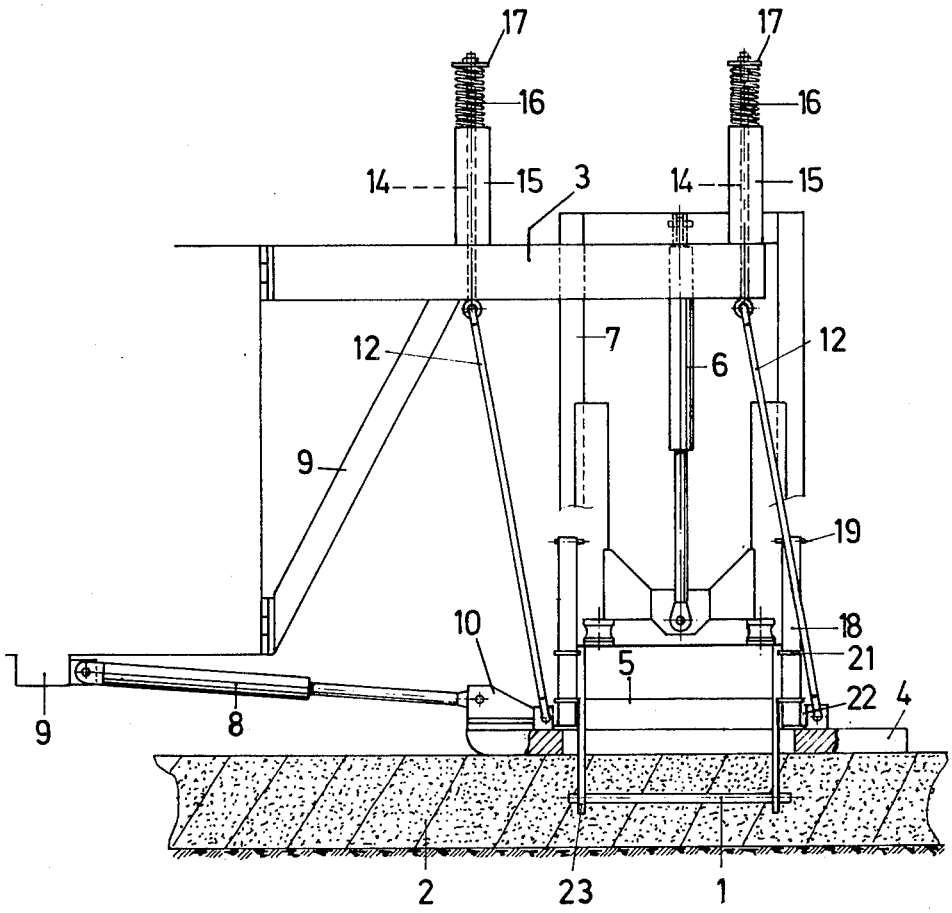
FIG. 4 is a view similar to that of FIG. 3 showing a further step of the use of the device.

Pairs of pressing guides 23 fixed to the horizontal beam 5 are regularly distributed between the pairs of lateral grips 18, said grips being located in front of each other. Each pressing guide 23 comprises a bar having in its lower end a notch 27 which is downwardly open. Said guides are laterally fixed to the horizontal beam 5 and are directed downwardly. When the horizontal beam 5 is lowered, the pressing guides 23, which are also moved downwardly, push the dowels 1 downwardly and cause the arms of the maintaining grips 18 to become open against the action of the return springs 20, so as to release said dowels 1 which are then driven into the concrete by pressing guides 23 through openings 26 of the smoothing plate 4 (FIG. 4).

The horizontal beam 5 is preferably equipped with one or several vibrators 25 which are mounted on its upper face and are capable of transmitting suitable vibrations to said beam 5.

Before driving and positioning the dowels 1 into the still unhardened and substantially plastic concrete of the slabs 2, the above described device is located above said slabs 2 and the smoothing plate 4 of said device bears against the surface of these slabs. In the upper position (FIG. 3) of the horizontal beam 5, the dowels 1 are seized by the side grips 18. For this purpose, the ends of the dowels 1 are inserted in the recesses 24 of the grips 18 and the weight of said dowels 1 is supported by the bottoms of said recesses 24 which are provided in the ends of the arms of said grips 18.

For driving the dowels into the concrete slabs 2, the horizontal beam 5 is lowered by operating the vertically moving jacks 6. During the lowering of the horizontal beam 5, the lower ends of the grips 18 contact the upper face of the smoothing plate 4. During the subsequent downward movement of the horizontal beam 5, the grips 18 remain in the same position, but said horizontal beam 5 moves further downwardly together with the pressing guides 23 and slides along the stopped grips 18. During the final lowering step of the horizontal beam 5, the pressing guides 23 contact the dowels 1 and exert on the latter downwardly directed forces.

The pressing guides 23 then push the dowels 1, through the openings 26 of the smoothing plate 4, into the concrete slabs 2 until said dowels reach their final lower position.

Due to the presence of the smoothing plate 4, when the dowels 1 are driven into the concrete slabs 2, the surface of the latter is only very slightly disturbed, notwithstanding the vibrations caused by the downward movement of the dowels 1.

These slight perturbations of the surface of the slabs 2, at the place where the dowels 1 are driven into said slabs 2, are easily removed by the smoothing plate itself 4, the latter sliding onto the surface of the slab 2, when the device in question is retracted toward the compacting-finishing machine by the jack 8.

The above described device thus allows one to drive and position accurately and directly a large number of dowels, without using skilled labour and without operation difficulties, into concrete slabs, without disturbing seriously the upper surface of these slabs during the positioning of the dowels, said surface being made again even by the smoothing plate 4, when the latter is retracted by the jacks 8.

This invention is obviously not limited to the embodiment shown in the drawings, since many changes may be made in the shape, the arrangement and the constitution of elements used in said embodiment, without departing from the scope of the invention.

What is claimed is:

1. A device for driving and positioning, by vibration, dowels (1) into concrete slabs (2), during the construction of roads, on both sides of joints between said slabs and perpendicularly to said joints, comprising a horizontal beam (5) which is provided with vibrators and with maintaining elements (18) suitable for gripping the dowels and which is carried in guides (7) of an independent frame, so as to be vertically movable by displacement means above a joint, in order to drive said dowels into a lower position in the still unhardened concrete of the slabs, said device comprising also a lower smoothing plate (4) intended to bear and slide onto the surface of the already compacted concrete slabs (2), said lower plate having openings (26) for the passage of the dowels (1) and pressing guides (23) fixed to the horizontal beam (5) during the lowering of said horizontal beam (5), said elements (18) for maintaining the dowels (1) being connected to the horizontal beam (5) and to the pressing guides (23) so as to allow the horizontal beam and the pressing guides to move downwardly with respect to the maintaining elements (18) bearing on the lower plate (4), so as to cause the dowels (1) to be driven into the still unhardened concrete of the slabs (2).

2. A device according to claim 1, comprising driving means attaching the device to the frame (9) of a compacting-finishing machine provided with a sliding shuttering and which distributes, compresses and finishes a concrete slab and advances continuously, said driving means allowing a discontinuous movement of said device with respect to said machine.

3. A device according to claim 2, which is attached to said machine by jacks (8) acting in a direction which is parallel to the direction of advancement of said machine.

4. A device according to claim 2, which is attached to said machine by jacks (8) acting in a direction which is parallel to the direction of advancement of said machine, said device being also suspended on extended members (3) connected to the frame (9) of said machine by means of link means which are capable of causing a part of the weight of said device to be supported by said frame (9) of the machine.

5. A device according to claim 4, in which said means capable of causing a part of the weight of the device to be supported by said frame (9) of the machine comprise a compensation mechanism (13) whereby a constant but adjustable weight of the device bears on the frame (9) of said machine.

6. A device according to claim 4, in which the link means (11) comprise pairs of rods (12) each forming a linked parallelogram with the extended members (3) of the frame (9) of the machine and with the lower smoothing plate (4) of the device.

7. A device according to claim 6, in which said means capable of causing a part of the weight of the device to be supported by said frame of the machine comprise a compensation mechanism whereby a constant but adjustable weight of the device bears on the frame (9) of said machine, the compensation mechanism (13) comprising arms (14) linked to the rods (12) and suspended on springs (16).

8. A device according to claim 6, in which said means capable of causing a part of the weight of the device to be supported by said frame of the machine comprise a compensation mechanism whereby a constant but adjustable weight of the device beas on the frame of said machine, the compensation mechanism (13) comprising arms (14) linked to the rods and suspended on springs (16) which bear against a guide carried by the extended members (3) of the frame (9) of the compacting-finishing machine.

9. A device according to claim 1, in which the dowel maintaining elements (18) are arranged so as to be able to slide onto said horizontal beam (5) on both sides of the pressing guides (23), in order to modify the distances between the dowels pushed by the same pressing guide.

10. A device according to claim 1, in which the dowel maintaining elements (18) consist of grips.

* * * * *

UNITED STATES PATENT AND TRADEMARK OFFICE

CERTIFICATE OF CORRECTION

PATENT NO. : 4,433,936

DATED : February 28, 1984

INVENTOR(S) : Andreas MOSER

It is certified that error appears in the above-identified patent and that said Letters Patent is hereby corrected as shown below:

First page, at Section "[54]" in the title, please correct the title by changing "TOWELS" TO --DOWELS--.

Column 1, in the title, please correct the title by changing "TOWELS" to --DOWELS--.

Signed and Sealed this

*Fifth* Day of *June 1984*

[SEAL]

*Attest:*

GERALD J. MOSSINGHOFF

*Attesting Officer*

*Commissioner of Patents and Trademarks*